US006815892B2

(12) United States Patent
Morimoto et al.

(10) Patent No.: US 6,815,892 B2
(45) Date of Patent: Nov. 9, 2004

(54) DISCHARGE LAMP WITH METAL OXIDE COATING

(75) Inventors: Yukihiro Morimoto, Himeji (JP); Katsumi Sugaya, Takasago (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/237,734

(22) Filed: Sep. 10, 2002

(65) Prior Publication Data

US 2003/0052608 A1 Mar. 20, 2003

(30) Foreign Application Priority Data

Sep. 12, 2001 (JP) ..... 2001-276772

(51) Int. Cl.[7] ..... H01J 61/04

(52) U.S. Cl. ..... 313/633; 313/318.06; 313/624; 313/625; 313/623; 439/611; 439/612

(58) Field of Search ..... 313/633, 318.06, 313/624, 625, 623; 439/611, 612

(56) References Cited

U.S. PATENT DOCUMENTS 5,006,757 A * 4/1991 Odagaki ..... 313/623
5,023,506 A * 6/1991 Canale et al. ..... 313/25
5,077,505 A * 12/1991 Ekkelboom et al. ..... 313/623
5,138,227 A * 8/1992 Heider et al. ..... 313/623
5,159,239 A * 10/1992 Ekkelboom et al. ..... 313/623
5,614,787 A * 3/1997 Kawai et al. ..... 313/623
5,789,850 A * 8/1998 Iwafuji et al. ..... 313/318.08
5,986,403 A * 11/1999 Jansen et al. ..... 313/623
6,271,627 B1 * 8/2001 Morimoto et al. ..... 313/623
6,356,018 B1 * 3/2002 Higashimoto et al. ..... 313/623

FOREIGN PATENT DOCUMENTS

| | | |
|---|---|---|
| AT | 004 408 U1 | 6/2001 |
| GB | 2 045 741 A | 11/1980 |
| GB | 1 485 378 | 9/1997 |

OTHER PUBLICATIONS

Patent Abstracts of Japan vol. 2000, No. 25, Apr. 12, 2001 & JP 2001 & JP 2001 236926 A (Ushio Inc.), Aug. 31, 2001.
European Search Report Dated Sep. 1, 2003.

* cited by examiner

*Primary Examiner*—Nimeshkumar D. Patel
*Assistant Examiner*—Holly Harper
(74) *Attorney, Agent, or Firm*—Nixon Peabody LLP; David S. Safran

(57) ABSTRACT

In a discharge lamp which has a silica glass discharge vessel with an arc tube portion and hermetically sealed portions in which in the hermetically sealed portions of this discharge vessel metal foils are installed and hermetically sealed areas are formed, in accordance with the invention has a high endurance of the sealing action in the hermetically sealed areas and thus a long service life is obtained by a coating layer being formed on at least one side of the respective metal foil. The coating layer is formed from at least one metal oxide which is selected from titanium oxide, lanthanum oxide, tantalum oxide, zirconium dioxide which can contain yttrium oxide, and from hafnium dioxide which can contain yttrium oxide. Furthermore, the metal oxide which forms the coating layer is advantageously crystalline, and moreover, can be formed over a base layer which is made of aluminum oxide or yttrium oxide.

9 Claims, 2 Drawing Sheets

DISCHARGE LAMP WITH METAL OXIDE COATING

BACKGROUND OF THE INVENTION

1. Field of the Invention

The invention relates to a discharge lamp which is advantageously used, for example, as a light source of a liquid crystal display device or the like.

2. Description of Related Art

As the light source part of a liquid crystal display device of the projection type or the like, a discharge lamp is used which has a discharge vessel consisting of silica glass and which has a spherical or oval arc tube portion and hermetically sealed portions which are located bordering the two ends of this arc tube portion. In this discharge lamp, furthermore, there is a pair of opposed electrodes in the arc tube portion, and the electrode rods of these electrodes are connected to molybdenum metal foils (hereinafter also called "molybdenum foils") which are installed in the hermetically sealed portions and which form electrical feed bodies. In this discharge lamp, hermetically sealed areas are formed by the directly adjoining tight arrangement produced by melting of the silica glass which forms the hermetically sealed portions onto the surfaces of these molybdenum foils.

However, in a discharge lamp with these hermetically sealed areas, on the boundary surfaces between the molybdenum foils as the conductive bodies and the silica glass as the nonconductive body there is a large potential gradient. This results in the phenomenon that cations such as alkali ions or the like collect as impurities in the silica glass in the vicinity of the boundary surface to the molybdenum foils. When the discharge lamp is shifted into the sealed state and when it reaches a high temperature state, in the silica glass comprising the hermetically sealed portions, crystallization nuclei are formed, for example, by the cations. As a result, a phase conversion occurs and a crystal body, such as quartz, cristobalite or the like is formed. One such conversion into a crystal body makes nonuniform the boundary surface structure between the molybdenum and the silica glass which has been produced by the sealing process, and diminishes the mechanical strength. Cracks form in the silica glass comprising the hermetically sealed portions, therefore, proceeding from the locations of the boundary surfaces to the molybdenum foils, by which the sealing action in the hermetically sealed areas is lost. Finally, there was the disadvantage that the expected service life of the discharge lamp cannot be obtained.

The silica glass and the molybdenum foils are joined to one another by a physical force, the penetration of silica glass into the concave parts and convex parts of the surfaces of the molybdenum foils and by a chemical force which is formed by the chemical bonding of the two. However, this chemical bond is destroyed by the attack of an alkali metal or alkali halogenide. The adhesive strength between the silica glass and the molybdenum foils therefore gradually decreases; this leads to detachment of the molybdenum foils from the silica glass. For this reason, the sealing action in the hermetically sealed areas is gradually lost. Finally, there was the disadvantage that the expected service life of the discharge lamp cannot be maintained.

SUMMARY OF THE INVENTION

The invention was devised to eliminate the above described defects in the prior art. Thus, an object of the invention is to devise a discharge lamp which has hermetically sealed areas using metal foils in which the endurance in the above described hermetically sealed areas is high and in which a long service life is obtained as a result.

In a discharge lamp which has a silica glass discharge vessel which has an arc tube portion in which there is a pair of opposed electrodes and which has hermetically sealed portions which are located on the ends of this arc tube portion, in which in the hermetically sealed portions of this discharge vessel molybdenum metal foils which form electrical feed bodies are installed, and in which, thus, hermetically sealed areas are formed, the object is achieved in accordance with the invention in that, at least on one side of the above described respective metal foil, a coating layer is formed from at least one metal oxide which is selected from titanium oxide, lanthanum oxide and tantalum oxide.

Furthermore, in a discharge lamp which has a silica glass discharge vessel which has an arc tube portion in which there is a pair of opposed electrodes, and which has hermetically sealed portions which are located on the ends of this arc tube portion, in which, in the hermetically sealed portions of this discharge vessel, molybdenum metal foils which form electrical feed bodies are installed, and in which hermetically sealed areas are formed, the object is achieved according to the invention in that, at least on one side of the above described respective metal foil, a coating layer is formed from at least one metal oxide which is selected from zirconium dioxide which contains 0% by mole to 20% by mole yttrium oxide, and hafnium oxide which contains 0% by mole to 40% by mole yttrium oxide.

Furthermore, in accordance with the invention, the object is advantageously achieved in the above described arrangement in that the metal oxide which forms the coating layer is crystalline.

Furthermore, according to the invention, the object is advantageously achieved in the above described arrangement in that the coating layer is formed over a base layer which is made of aluminum oxide or yttrium oxide, at least on one side of the above described respective metal foil.

In the discharge lamp of the invention, at least one side of the respective molybdenum metal foil is surrounded by a coating layer in the hermetically sealed area which forms the electrical feed body. For this reason the alkali metal cations and the like which are present as impurities in the silica glass comprising the hermetically sealed portions move into the vicinity of the metal foils and collect there. By coating the metal foils with coating layers which consist of a certain metal oxide, deterioration of the characteristic by the effect of the cations is prevented. Moreover a phase conversion in the silica glass which is caused by the accumulation of cations is prevented. As a result, very high endurance of the hermetically sealed areas in these hermetically sealed portions is obtained. As a result a long service life in the discharge lamp can be obtained.

The invention is further described below using the accompanying drawings.

DETAILED DESCRIPTION OF THE INVENTION

Figure 1:
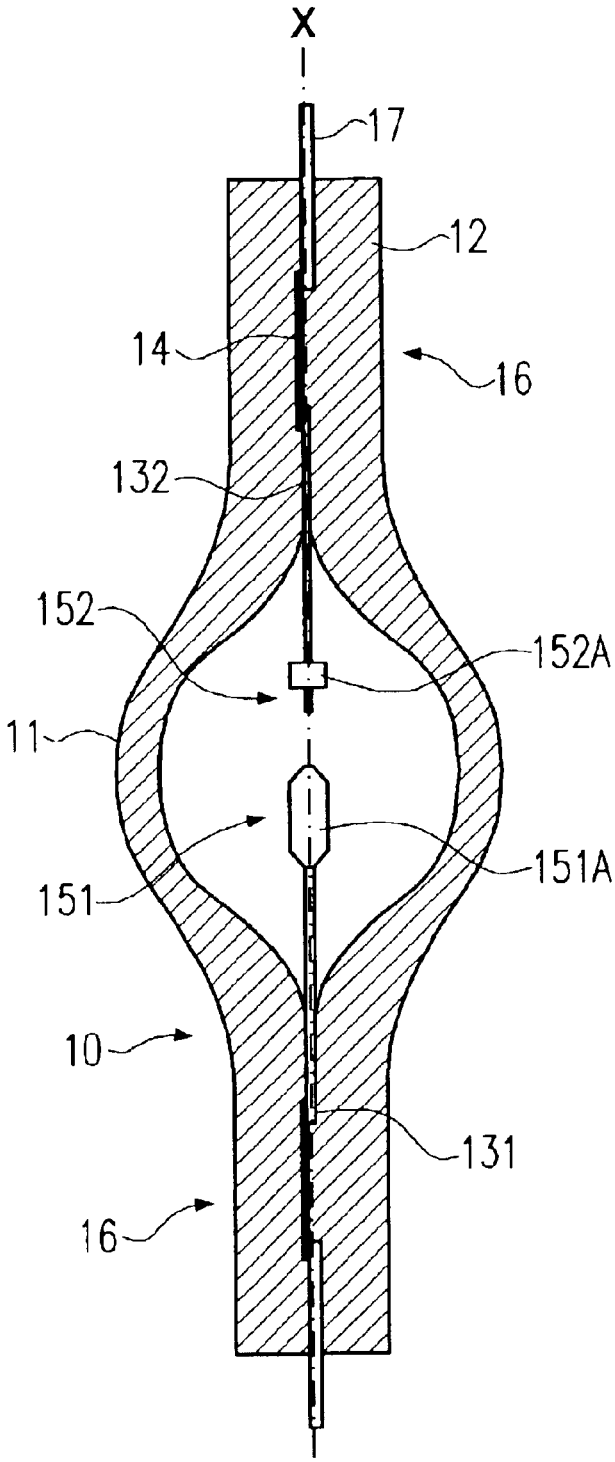
FIG. 1 is a schematic cross-sectional view showing the arrangement of one example of a discharge lamp in accordance with the invention taken along the tube axis.
Figure 2:
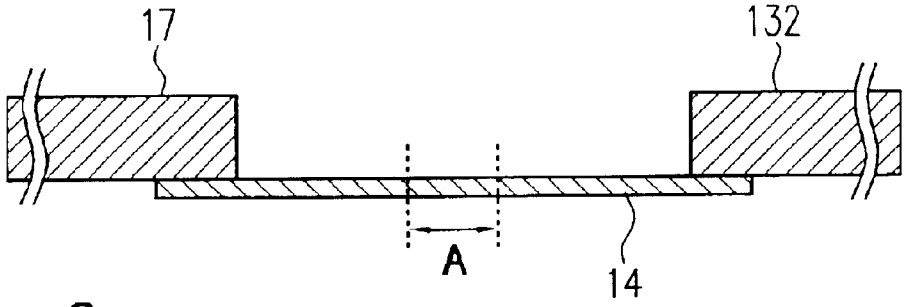
FIG. 2 shows an enlarged schematic cross section of the hermetically sealed area of the lamp shown in FIG. 1.

The embodiment of a discharge lamp according to the invention shown in FIG. 1 has a silica glass discharge vessel 10 which has an oval arc tube portion 11 and rod-shaped hermetically sealed portions 12 which are located bordering the two ends of this arc tube portion 11 such that they project to the outside from these two ends.

In the arc tube portion 11 of the discharge vessel 10, on the tube axis X of the discharge vessel 10, there are an opposed anode 151 and cathode 152 which have been brought near one another. The anode 151 is made, for example, of tungsten. An anode body 151A is attached on the tip of the electrode rod 131 and has a tip area which is made in the shape of a truncated cone such that its outside diameter decreases in the direction toward the tip. The cathode 52 has a cylindrical cathode body 152A, for example, of tungsten, attached and held on the electrode rod 132.

In one of the hermetically sealed portions 12 of the discharge vessel 10, for example, a tungsten electrode rod 131 extends along the tube axis X, and one end of the electrode rod 131 extends into the hermetically sealed portion 12 and is, moreover, connected to the inner end of a molybdenum metal foil 14 (hereinafter also called only "molybdenum foil") which is hermetically installed in this hermetically sealed portion 12 and which forms an electrical feed body. The inner end of the outer lead pin 17, which projects to the outside from the outer end of the hermetically sealed portion 12, is connected to the outer end of this molybdenum foil 14. In this way, a hermetically sealed area 16 is formed.

In the other hermetically sealed portion of the discharge vessel 10, a hermetically sealed area 16 is formed with respect to the electrode rod 132 as in the arrangement of the hermetically sealed area 16 with respect to the electrode rod 131 in a hermetically sealed portion 12 by a metal foil 14.

Dimensions are described below by way of example:

- the maximum outside diameter of the arc tube portion 11 is 10 mm to 13 mm;
- the maximum inside diameter of the arc tube portion 11 is 4.0 mm to 5.0 mm;
- the total length (length in the direction of the tube axis X) of the interior space of the discharge vessel 10 is 9.0 mm to 11.0 mm;
- the length of the hermetically sealed portion 12 is 16 mm to 50 mm;
- the outside diameter of the hermetically sealed portion 12 is 5.8 mm to 7.4 mm;
- the volume of the interior space is 50 $mm^3$ to 100 $mm^3$; and
- the interior area of the arc tube portion 11 is 50 $mm^2$ to 150 $mm^2$.

Furthermore, for the electrode rods 131, 132, their maximum outside diameter is, for example, 0.3 mm to 1.0 mm and advantageously 0.5 mm to 0.8 mm.

The molybdenum foil 14 is made in the form of a thin strip and its thickness is, for example, 20 $\mu$m to 30 $\mu$m, advantageously 25 $\mu$m. Furthermore, its length in the direction of the tube axis X is from 7 mm to 15 mm, advantageously 11 mm, and its width is 1.0 mm to 3.0 mm, advantageously 1.5 mm.

Figure 3:
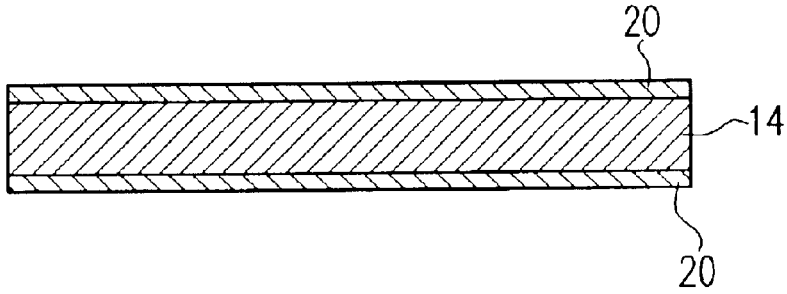
FIG. 3 is an enlarged cross-sectional view of the area A of FIG. 2.

On the entire surface of the respective molybdenum foil 14, as shown in FIG. 3, a coating layer 20 of a certain metal oxide described below (hereinafter also called only the "coating layer") is formed which is present between the molybdenum foil 14 and the silica glass comprising the hermetically sealed portion 12.

The metal oxide comprising the coating layer 20 can be at least one type of metal oxide which has been chosen from titanium dioxide, lanthanum oxide, tantalum oxide, zirconium dioxide and hafnium dioxide (hereinafter also called only a "certain metal oxide").

Here, for example, zirconium dioxide can be used which contains less than or equal to 20% by mole yttrium oxide, advantageously less than or equal to 15% by mole yttrium oxide, especially advantageously 3% by mole yttrium oxide. For example, hafnium dioxide can also be used; it contains less than or equal to 40% by mole yttrium oxide, advantageously less than or equal to 20% by mole yttrium oxide, especially advantageously 3% by mole yttrium oxide.

In the above described certain metal oxide, the coefficient of thermal expansion at 20° C. is from $1.0\times10^{-6}$/K to $10.0\times10^{-6}$/K and is identical or close to the coefficient of thermal expansion of molybdenum. In this way, when a high temperature of the discharge lamp is reached by lamp operation, this coating layer 20 is prevented from detaching from the molybdenum foil 14 due to the difference between the coefficient of thermal expansion of the coating layer 20 and the coefficient of thermal expansion of the molybdenum foil 14 or cracks are prevented from forming. Furthermore, the certain metal oxide is chemically bound by forming a compound with the silica glass comprising the hermetically sealed portion 12. With a certain metal oxide, the occurrence of a phase conversion due to the action of the cations is prevented.

The thickness of the coating layer 20 is from 10 nm to 5000 nm, advantageously 30 nm to 4000 nm, even more advantageously 50 nm to 3000 nm.

It is desirable that the above described certain metal oxide comprising the coating layer 20 is crystalline.

The coating layer 20 can be formed by adhesion of a certain metal oxide on the entire surface of the molybdenum foil 14. Specifically, a gas phase vapor deposition process or accumulation method, such as a sputtering process, an "electron cyclotron resonance" process, a "chemical vapor deposition" process or the like are advantageous processes. In particular a sputtering process can be advantageously used.

The above described coating layer 20 need not be formed on the entire surface of the molybdenum foil 14, but can also be formed on only one side in order to be effective.

The interior of the discharge vessel 10 is filled, for example, with at least 0.16 mg/$mm^3$ mercury, $2\times10^{-4}$ $\mu$mole/$mm^3$ to $7\times10^{-4}$ $\mu$mole/$mm^3$ halogen and a rare gas filler gas such as argon or the like. Preferably, the internal pressure during operation is at least $1\times10^7$ Pa and continuous spectra of visible light with wavelengths, for example, from 380 nm to 780 nm can be emitted and a discharge lamp obtained which is advantageously a light source of a liquid crystal projector.

The halogen can be bromine, chlorine, iodine and the like. Because the amount of halogen added to the interior of the discharge vessel 10 is at least $2\times10^{-4}$ $\mu$mole/$mm^3$, UV radiation in a wavelength range from 126 nm to 185 nm is absorbed. In this way, milky opacification of the silica glass comprising the arc tube portion 11 is adequately suppressed. Furthermore, by the amount of halogen being less than or equal to $7\times10^{-4}$ $\mu$mole/$mm^3$, serious deformation and heavy wear of the electrodes by an overly large amount of halogen can be effectively prevented. By using the bromine in the above described arrangement, the stability of the emission characteristic in the discharge lamp over time can be increased.

In the discharge lamp with the above described arrangement, the endurance of the hermetically sealed areas 16 formed in the hermetically sealed portions 12 becomes very large, as is also apparent from the embodiments described below. In the hermetically sealed portions 12 of this discharge lamp, due to the formation of the coating layers 20 on the surfaces of the molybdenum foils 14, the alkali metal cations accumulate on the coating layers 20. Thus, phase conversion or the like in the silica glass is prevented. Moreover, the chemical bond of the certain metal oxide to the silica glass is stable against the attack of an alkali metal or the like. As a result, detachment in the hermetically sealed area 16 is effectively prevented from occurring.

By the above described measure that in the hafnium dioxide or zirconium dioxide comprising the coating layers 20 yttrium oxide with a certain ratio is contained, the molecule arrangement in the hafnium dioxide or zirconium dioxide is stabilized. Crystallization by phase conversion is therefore prevented. Furthermore, the certain metal oxide is also extremely stable as a phase at a high temperature because this certain metal oxide comprising the coating layers 20 is crystalline. Therefore, its characteristic is prevented from degrading by the effect of the alkali metal cations or the like.

One version of the invention was described above. But various modifications are possible in accordance with the invention.

Figure 4:
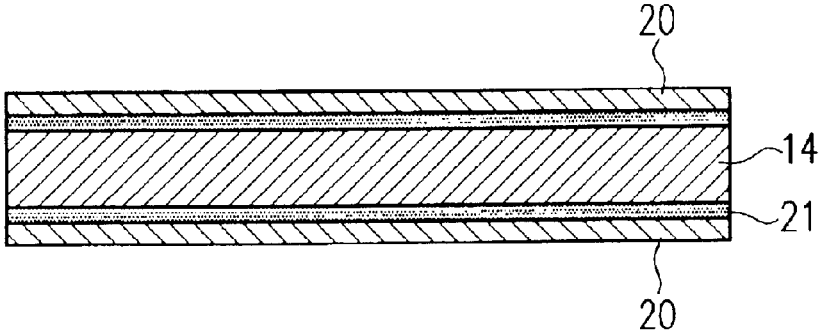
FIG. 4 shows an enlarged schematic cross section of area A in FIG. 2 in accordance with a modified embodiment.

For example, a base layer 21 can be provided on the surface of the molybdenum foil 14, first of all, and on this base layer 21, a coating layer 20 can be formed, as is shown in FIG. 4. The material comprising this base layer 21 can be yttrium oxide or aluminum oxide which has a low diffusion rate for alkali metal cations. It is especially desirable to use yttrium oxide. By forming such a base layer 21, the presence of alkali metal cations on the boundary surface between the molybdenum foil 14 and the coating layer 20 is suppressed. As a result, the adhesive strength between the molybdenum foil 14 and the silica glass comprising the hermetically sealed portion 12 can be increased. It is desirable for the layer thickness of the base layer 21 to be 10 nm to 2000 nm, especially 50 nm to 1000 nm.

Furthermore, in addition to the above described formation of coating layer 20 on the surface of the molybdenum foil 14 (with or without the base layer 21), a silica layer can be formed by a suitable means, such as, for example, by a sputtering process, by precipitation such that the coating layer 20 is coated. This silica layer has a thickness of, for example, 20 $\mu$m. This prevents the metal oxide from vaporizing in shrink sealing and adhering to the inside of the arc tube portion 11, and in this way, its translucency from being adversely affected. At the same time, the adhesion on the silica glass comprising the hermetically sealed portion 12 is increased. This silica layer can be formed after the electrode rods 131, 132 and the outer lead pins 17 have been welded onto the surfaces of the molybdenum foils 14.

The discharge lamp is not limited to the direct current operating type, but the discharge lamp can also be of the alternating current operating type.

Embodiments of the discharge lamp in accordance with the invention are specifically described below; but, the invention is not limited thereto.

(Embodiment 1)

The total area of a molybdenum foil (14) with a length of 11 mm, a width of 1.5 mm and a thickness of 25 $\mu$m was subjected to sputtering using argon gas as the internal gas under ambient conditions, a gas flow amount of 50 $cm^3$/minute and an internal pressure of the chamber of 0.4 Pa, furthermore using titanium dioxide as the target material and under the condition of a layer formation rate of 10 nm/minute. Simultaneously, the duration of this sputtering was controlled. In this way, coating layers 20 of titanium oxide with layer thickness of 50 nm, 500 nm and 3000 nm were formed.

An electrode rod 132 of tungsten with an outside diameter of 0.8 mm and an outer lead pin 17 of tungsten with an outside diameter of 0.5 mm were each welded to a respective end of the molybdenum foil 14 on which this coating layer (20) was formed. Thus, a mount was produced.

By heat treatment under conditions of a hydrogen atmosphere and 900° C. with a duration of 30 minutes, using a mount from which the oxide which had formed on the electrode surfaces has been removed, and according to the arrangement shown in FIG. 1, discharge lamps with the specifications described below were produced.

A discharge vessel 10 of silica glass in which the total length of the interior is 10.0 mm, the outside diameter of the arc tube portion 11 is 10.5 mm, the inside diameter of the arc tube portion 11 is 4.5 mm, the length of the hermetically sealed portion 12 is 20 mm, the outside diameter of the hermetically sealed portion 12 is 6.0 mm, the volume of the interior is 75 $mm^3$ and the internal area of the arc tube portion 11 is 100 $mm^2$, and the above described mount were used. The interior of the discharge vessel 10 was filled with 17 mg mercury, 3.8 $\mu$mole bromine and argon gas with a pressure during filling of 13.3 kPa as the fillers, and moreover by shrink sealing, hermetically sealed areas 16 were formed. In this way, discharge lamps with a rated wattage of 150 W, a wall load of 1.5 $W/mm^2$ and an internal pressure during operation of 15 MPa (150 atm) were produced.

An endurance test was carried out such that the discharge lamps produced in this way under rated conditions were subjected to five hours of operation using a direct current, that adjacent areas of the molybdenum foils (14) of these discharge lamps were visually observed, and that the presence or absence of detachment in the hermetically sealed areas (16) was confirmed.

The results are shown below using Table 1.

(Embodiments 2 to 5)

Discharge lamps were produced in the same way as in embodiment 1, except for the fact that the metal oxides shown in Table 1 were used instead of titanium dioxide as the metal oxide comprising the coating layer 20, and in the same way, as in embodiment 1 an endurance test was done and the presence or absence of detachment in the hermetically sealed areas 16 was confirmed.

(Embodiment 6)

The total area of a molybdenum foil (14) with a length of 11 mm, a width of 1.5 mm and a thickness of 25 $\mu$m was subjected to sputtering using argon gas as the internal gas, under ambient conditions of a gas flow amount of 50 $cm^3$/minute and an internal pressure of the chamber of 0.4 Pa, furthermore using yttrium oxide as the target material and under the condition of a layer formation rate of 10 nm/minute. In this way, a base layer 21 of yttrium oxide with a layer thickness of 100 nm was formed, onto which a coating layer 20 of titanium oxide was formed by coating. Otherwise, the discharge lamps were produced in the same way as in embodiment 1, an endurance test was run and the presence or absence of detachment in the hermetically sealed areas 16 was confirmed.

(Embodiment 7)

Discharge lamps were produced in the same manner as in embodiment 6, except for formation of a base layer 21 of aluminum oxide by sputtering using aluminum oxide as the target material, an endurance test was done and the presence or absence of detachment in the hermetically sealed areas 16 was confirmed.

The results in the above-described embodiments 1 to 7 are shown using the Table 1.

COMPARISON EXAMPLE

Discharge lamps were produced in the same manner as in embodiment 1, except for the fact that no coating layers 20 were formed on the surfaces of the molybdenum foils, an endurance test was performed and the presence or absence of detachment in the hermetically sealed areas 16 was confirmed.

The results are shown using Table 1.

TABLE 1

| | Coating Layer Material | Layer Thickness (nm) | Number | Number of Broken Lamps (Item) | Number of Lamps in which detachment occurred (Item) |
|---|---|---|---|---|---|
| Embodiment 1 | Titanium Dioxide ($TiO_2$) | 50 | 2 | 0 | 0 |
| | | 500 | 9 | 0 | 0 |
| | | 3000 | 2 | 0 | 0 |
| Embodiment 2 | Lanthanum Oxide ($La_2O_3$) | 50 | 2 | 0 | 0 |
| | | 500 | 8 | 0 | 0 |
| | | 3000 | 2 | 0 | 0 |
| Embodiment 3 | Tantalum Oxide ($Ta_2O_3$) | 50 | 2 | 0 | 0 |
| | | 500 | 8 | 0 | 0 |
| | | 3000 | 2 | 0 | 0 |
| Embodiment 4 | Zirconium Dioxide ($ZrO_2$), Yttrium Oxide (3 mol-% $Y_2O_3$) | 50 | 2 | 0 | 0 |
| | | 500 | 9 | 0 | 0 |
| | | 3000 | 2 | 0 | 0 |
| Embodiment 5 | Hafnium Dioxide ($HfO_2$), Yttrium Oxide (3 mol-% $Y_2O_3$) | 50 | 2 | 0 | 0 |
| | | 500 | 6 | 0 | 0 |
| | | 3000 | 2 | 0 | 0 |
| Embodiment 6 | Base Layer of Yttrium Oxide ($Y_2O_3$) and Coating Layer of Titanium Oxide ($TiO_2$) | 50 | 2 | 0 | 0 |
| | | 500 | 2 | 0 | 0 |
| | | 3000 | 2 | 0 | 0 |
| Embodiment 7 | Base Layer of Aluminum Oxide ($Al_2O_3$) and Coating Layer of Titanium Oxide ($TiO_2$) | 50 | 2 | 0 | 0 |
| | | 500 | 2 | 0 | 0 |
| | | 3000 | 2 | 0 | 0 |
| Comparison example | None | none | 9 | 2 | 5 |

The above described table shows that by forming the coating layer 20 from a certain metal oxide on the surfaces of the molybdenum foils 14 or by forming the base layer 21 and the coating layer 20 high endurance in the hermetically sealed areas 16 can be obtained.

In the above described embodiments 6 and 7, in the case in which the coating layer 20 is formed, instead of from titanium dioxide, from zirconium dioxide which contains 3% by mole yttrium oxide, lanthanum oxide, tantalum oxide, or from hafnium dioxide which contains 3% by mole yttrium oxide, advantageous results are likewise obtained. In these cases, it was also confirmed that high endurance was obtained in the hermetically sealed areas 16.

In the above described embodiments, if a silica layer with a layer thickness of 200 nm was formed on the coating layer 20, likewise by a sputtering process, a result was obtained which was just as advantageous as in the above described embodiments. In these cases as well, it was confirmed that high endurance was obtained in the hermetically sealed areas 16.

ACTION OF THE INVENTION

In the discharge lamp in accordance with the invention, at least one side of the respective metal foil of molybdenum which forms an electrical feed body in the hermetically sealed area which forms an electrical insertion body is covered with a coating layer. Alkali metal cations which are present as impurities in the silica glass comprising the hermetically sealed portions move into the vicinity of the metal foils and accumulate there. By coating the metal foils with coating layers of a certain metal oxide, deterioration of the characteristic by the effect of the cations is prevented. Furthermore, a phase conversion in the silica glass as a result of cation accumulation is prevented. As a result, in the hermetically sealed areas in these hermetically sealed portions very high endurance, and as a result, in the discharge lamp, a long service life are obtained.

What we claim is:

1. Discharge lamp comprising:

a silica glass discharge vessel with an arc tube portion and hermetically sealed portions located on ends of the arc tube portion;

a pair of opposed electrodes in said arc tube portion, and molybdenum metal foils located wholly within said hermetically sealed portions, each of which is connected to an outer end of a respective one of said electrodes;

wherein at least on one side of each metal foil a coating layer formed thereon said coating layer comprising at least one metal oxide selected from the group consisting of titanium oxide, lanthanum oxide, tantalum oxide, zirconium oxide and hafnium oxide.

2. Discharge lamp as claimed in claim 1, wherein the coating layer is disposed on a base layer of at least one metal oxide which is chosen from the group consisting of aluminum oxide and yttrium oxide.

3. Discharge lamp as claimed in claim 1, wherein the coating layer is disposed on only one side of each metal foil.

4. Discharge lamp as claimed in claim 1, wherein the metal oxide of the coating layer is crystalline.

5. Discharge lamp as claimed in claim 4, wherein the coating layer is disposed on a base layer of at least one metal oxide which is chosen from the group consisting of aluminum oxide and yttrium oxide.

6. Discharge lamp as claimed in claim 1, wherein the coating layer consists of at least one metal oxide selected from the group consisting of zirconium dioxide which contains up to 20% by mole yttrium oxide, and hafnium oxide which contains up to 40% by mole yttrium oxide.

7. Discharge lamp as claimed in claim 6, wherein the coating layer is disposed on a base layer of at least one metal oxide which is chosen from the group consisting of aluminum oxide and yttrium oxide.

8. Discharge lamp as claimed in claim 6, wherein the metal oxide of the coating layer is crystalline.

9. Discharge lamp as claimed in claim 8, wherein the coating layer is disposed on a base layer of at least one metal oxide which is chosen from the group consisting of aluminum oxide and yttrium oxide.

* * * * *